United States Patent [19]

Granberg

[11] Patent Number: 4,673,330

[45] Date of Patent: Jun. 16, 1987

[54] METHOD FOR CONTROL OF THE FUNCTION OF A CENTRIFUGAL PUMP

[75] Inventor: Bertil Granberg, Karlstad, Sweden

[73] Assignee: Kamyr AB, Karlstad, Sweden

[21] Appl. No.: 777,302

[22] Filed: Sep. 18, 1985

[30] Foreign Application Priority Data

Sep. 21, 1984 [SE] Sweden ..... 8404734

[51] Int. Cl.[4] ..... F01D 5/18; B01D 19/00

[52] U.S. Cl. ..... 415/1; 55/210; 55/218

[58] Field of Search ..... 415/13, 17, 20, 28, 415/30, 36, 39, 43, 25, 1; 55/18, 36, 199, 203, 210, 218

[56] References Cited

U.S. PATENT DOCUMENTS

| | | | |
|---|---|---|---|
| 3,846,038 | 11/1974 | Carriere et al. | 415/1 |
| 3,975,171 | 8/1976 | Burnham, Sr. et al. | 55/36 |
| 4,205,941 | 6/1980 | Fradin | 415/20 |
| 4,222,749 | 9/1980 | Moss | 55/18 |
| 4,228,753 | 10/1980 | Davis et al. | 415/115 |
| 4,416,581 | 11/1983 | Geary, Jr. | 416/97 R |

FOREIGN PATENT DOCUMENTS

| | | | |
|---|---|---|---|
| 187494 | 2/1937 | Switzerland | 415/17 |

*Primary Examiner*—Robert E. Garrett
*Assistant Examiner*—John Kwon
*Attorney, Agent, or Firm*—Nixon & Vanderhye

[57] ABSTRACT

A centrifugal pump having an impeller rotatable about an axis of rotation at its center has its operation controlled so as to regulate the size of a gas bubble. When pumping a liquid or suspension (such as paper pulp with a consistency of about 8–15 percent) which contains gas, the gas has a tendency to collect adjacent the impeller center, and impede operation of the pump. Using a number of electrodes which extend into operative association with the chamber of the pump in which the gas bubble tends to collect, and by taking advantage of the differences in electrical conductivity of the gas as compared to the liquid or suspension being pumped, the size of the gas bubble may be determined. When the size is too large, gas is automatically discharged from the pump. When an asynchronous motor drives the impeller, the pump power consumption can also be determined, and additionally the gas bubble size may be used to regulate the pump pressure head and the speed of the pump in order to obtain optimum operating efficiency.

15 Claims, 4 Drawing Figures

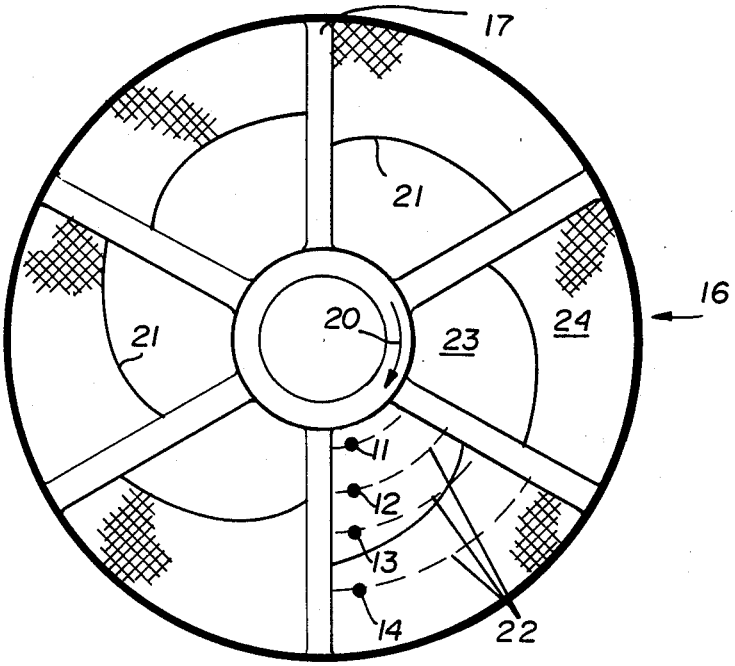
FIG. 3
FIG. 4
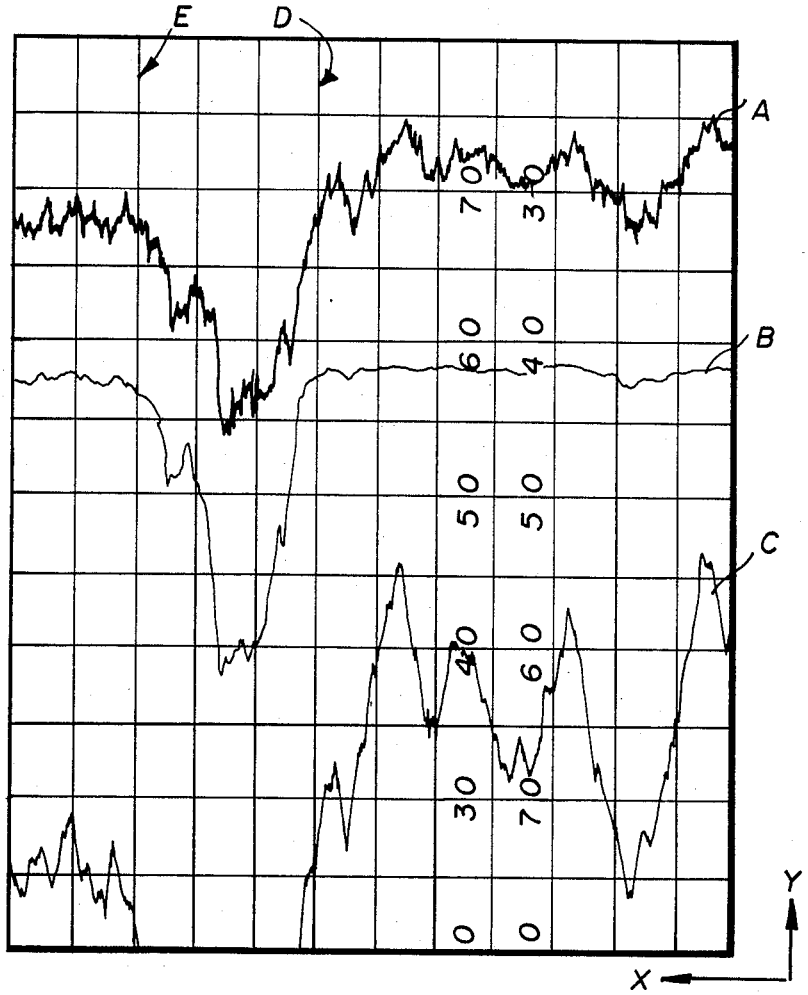

METHOD FOR CONTROL OF THE FUNCTION OF A CENTRIFUGAL PUMP

BACKGROUND AND SUMMARY OF THE INVENTION

During the pumping of a liquid or suspension containing gas, using a centrifugal pump, there is a tendency for the gas to collect at the center of the pump impeller in a bubble. This can be a significant problem in the pumping of a number of liquids or suspensions, such as cellulosic fibrous material suspensions (e.g. paper pulp) particularly those having a medium consistency, that is a solids consistency in the range of about 8–15 percent. If the bubble becomes too large, it hinders the pump operation. Therefore it is necessary to in some way control and regulate the gas collection so that the pump performance can be optimized.

In U.S. Pat. Nos. 4,410,337 and 4,435,193, the disclosures of which are hereby incorporated by reference herein, methods and apparatus for discharging gas from centrifugal pumps in order to control pump capacity are described. The gas is discharged through an outlet while the pump head and the pump output are controlled by maintaining a pressure difference between the suspension inlet and the gas outlet. However when the gas is controlled in this way, the pump often does not operate at peak efficiencies, and additionally there are problems that result in view of the fact that the pulp being pumped may contain varying quantities of gas, and other variables may exist.

According to the present invention, by taking advantage of the difference in electrical conductivity between the liquid or suspension being pumped, and the gas in the bubble being formed, it is possible to sense (e.g. measure) the size of the gas bubble. The discharge of gas from the pump is then controlled so as to regulate the size of the bubble so that it does not impede pump operation. However there is no necessity, in such a circumstance, for creating a pressure differential as exists in the above-mentioned U.S. patents.

The method is practiced by utilizing a plurality of electrodes which extend through a wall of the pump defining, with the impeller, a chamber in which the gas collects. The electrodes are radially spaced from each other, and from the axis of rotation of the pump, and are operatively connected through resistances to a source of direct or alternating current. A voltage meter is placed across one of the resistors—namely the resistor of the electrode that is closest to the axis of rotation, and the output from the voltage meter can be used to automatically control a valve, or other mechanism, for facilitating the discharge of air from the bubble.

Utilizing the present invention it is also possible to measure the rpm of the impeller, which, when compared to the idle rpm of an asynchronous motor which drives the impeller, can be used to determine the power consumption of the pump. Also it is possible to control the size of the gas bubble to regulate the pump pressure head so that it is in a predetermined range, and, in connection with the speed of the impeller, the volume capacity and power consumption can be controlled so as to obtain the greatest possible operating efficiency.

It is the primary object of the present invention to provide a method and apparatus for effective control of the operation of a centrifugal pump by maintaining the size of the bubble of gas collecting in the pump chamber within a predetermined range. This and other objects of the invention will become clear from an inspection of the detailed description of the invention, and from the appended claims.

BRIEF DESCRIPTION OF THE DRAWINGS

FIG. 3 is a view taken along lines 3—3 of FIG. 2 showing the pump impeller and the sawtooth radial periphery of the gas bubble; and FIG. 4 is a graphical representation of various operative functions of the pump according to the invention.

DETAILED DESCRIPTION OF THE DRAWINGS

Figure 1:
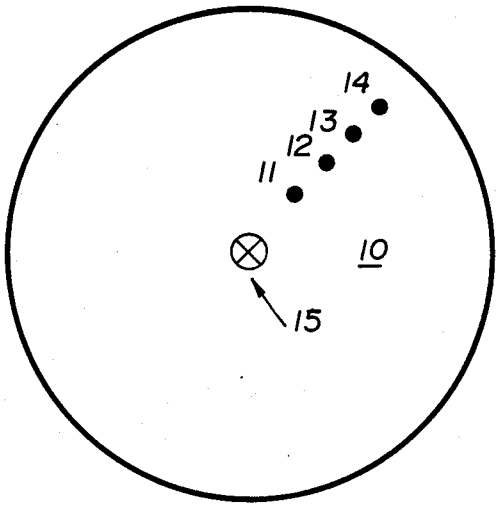
FIG. 1 is a schematic bottom plan view of the rear wall of a pump according to the present invention, showing electrodes passing through the wall at different radial spacings from the center of the pump.

The centrifugal pump according to the invention includes the rear wall 10 which defines with impeller 16 a chamber 16' (see FIG. 2) in which gas collects. The shaft 15 for rotating the impeller 16 is centrally located with respect to the pump casing rear wall 10 and impeller 16, and is rotatable about an axis of rotation 15A (see FIG. 2). An asynchronous motor 29, or the like, effects rotation of the shaft 15 about the axis 15A.

According to the present invention, means are provided for taking advantage of the differences in electrical conductivity between the gas collecting in the gas bubble, and the electrical conductivity of the liquid or suspension being pumped (e.g. paper pulp having a consistency of about 8–15 percent). Such means include the plurality of isolated electrodes 11, 12, 13, 14, which are radially spaced from each other and the axis of rotation 15A, and extend through the rear wall 10 of the pump. During normal operation, the radial periphery of the gas bubble will lie on a diameter between the diameters which correspond to the inner electrode 11 and the outer electrode 14.

A plurality of radial ribs 17 preferably are provided on the backside of the impeller 16, so that they rotate within the chamber 16'. As with all centrifugal pumps, the liquid or suspension being pumped is discharged through an outlet at the periphery 17' of the impeller 16, and chamber 16'. In this way, during rotation of the impeller in the direction of arrow 20 (see FIG. 3) a gas bubble which forms at a central part of the impeller, within chamber 16', will have the configuration indicated generally by reference numeral 23. That is the radial periphery of the gas bubble is defined by lines 21, and as can be seen has a generally sawtooth configuration. The location of the electrodes is indicated by the dots 11–14, with the locus of a point on a rib 17 at the same radial distance from the center of the pump as each of the electrodes 11–14 being indicated by the dotted lines 22. If the ribs 17 were not present in the chamber 16', the gas bubble may approximate a circular form, however it is desirable, as will be hereinafter explained, to ensure that the bubble configuration is not circular in order to facilitate precise control of the size of the gas bubble.

Figure 2:
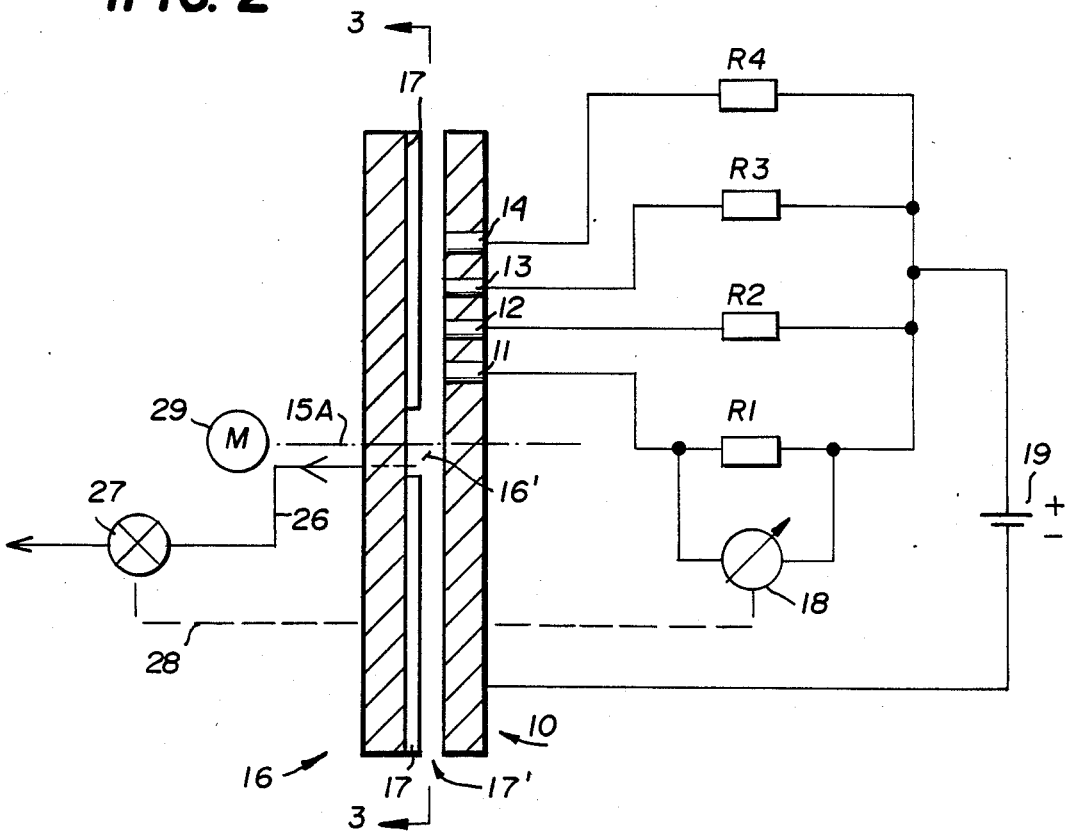
FIG. 2 is a schematic side cross-sectional view of the rear portion of a pump according to the present invention showing the electrical interconnection of the electrodes and various other components, that drive for the impeller, and the gas discharge from the pump.

With reference to FIG. 2, it will be seen that the electrodes 11–14 are electrically connected to a power source 19 through the resistors R1–R4, respectively. The power source 19 may be a direct or alternating current source, and may—as indicated in FIG. 2—have the negative terminal thereof operatively connected to the pump wall 10. A means for sensing the current passing through one or more of the electrodes is also provided, in the preferred embodiment that comprising the voltage meter 18 which is operatively connected across the resistor R1 associated with the innermost electrode 11.

Gas can be discharged from the bubble in the chamber 16' in order to reduce the size of the bubble by any suitable means such as disclosed in said U.S. Pat. Nos. 4,410,337 and 4,435,193, previously incorporated by reference herein. For instance in the drawings there is schematically illustrated a conduit 26 which passes from the chamber 16 through a valve 27; when the valve 27 is opened, gas passes through the conduit 26 to a low pressure area to which the valve downstream end is connected. The valve 27, or other suitable control mechanism, may be automatically operated in response to the voltage sensed by the meter 18, as schematically indicated by the control line 28.

FIG. 4 is a graphical representation of three different values that have been obtained during actual control of a pump as according to the present invention. The upper curve A indicates the pump head. The curve B indicates current signals from the outermost electrode 14. The curve C indicates current signals from the electrode 13. The vertical lines D and E indicate typical points on the curves where they slope dramatically downwardly, and recover, respectively. The arrow marked X indicates the time axis, while the arrow Y indicates the direction axis.

The graphical representations in FIG. 4 were obtained by operating a centrifugal pump during pumping of paper pulp having a consistency of about 10 percent. Four isolated electrodes 11 through 14 were utilized in the pump, having the end portions thereof co-planar with the inner surface of the wall 10 so that the electrodes could come into contact with the gas or pulp suspension in the chamber 16'. Due to a powerful rotation of the suspension which is caused by the ribs 17 on the impeller 16, the gas bubble 23 took the general form as illustrated in FIG. 3, having the generally sawtooth outer peripheral configuration as indicated by reference numerals 21. From an inspection of FIG. 3 it can be seen that during a part of the rotation with the gas bubble 23 having the size and configuration illustrated that the electrode 13 will be in contact with the pulp suspension 24, while during another part of the rotation it will be in contact with the gas bubble 23. As long as the bubble maintains the configuration illustrated in FIG. 3, the electrode 14 will always be in contact with suspension 24, while the electrode 12 will always be in contact with the gas in the bubble 23. When the electrode 13 is in contact with the suspension 24 a current passes through the resistor R3, while when it is in contact with merely gas no current passes therethrough. Of course the same is true with respect to each of the electrodes 11, 12, and 14 and their respective resistors R1, R2, and R4 also. When current is passing through all of resistors R1–R3, then the voltage measured by voltage meter 18 will, of course, be different than when it is passing only through resistors R1 and R2. When the voltage reaches a predetermined level, it can be used to control the discharge of the gas through control line 28, valve 27, etc.

In FIG. 4 the curve B for electrode 14 shows that the current was constant at a certain level at the right side of the diagram approximately to the vertical line D, while the current through electrode 13, which is indicated with the curve C, shows varying strength depending upon the size of the gas bubble. That is the greater the size of the bubble 23, the less current went through the electrode 13. These conditions are in good conformity with the upper curve A, which follows the curve C very well in such a way that the pump head is increasing when the gas bubble is decreasing in size, and the head decreases when the gas bubble is increasing in size. These conditions are still more clarified by studying what is happening with the curves at the vertical line D. Here the curve C is dropping so much lower that it soon comes outside the diagram because the gas bubble has been allowed to grow very large, but at the same time the electrode 14, which is located at a greater distance from the pump shaft, comes in contact with gas and it is possible by following its curve B from the vertical line D towards the left to find the same good correspondency between the curve B and the pressure head curve A approximately forward to the vertical line E, where again the size of the gas bubble 23 has been decreased so that the curve B is evening out to a horiozntal curve while the curve C in the lower left corner of the figure again comes into the diagram.

By equipping the impeller 16 with ribs 17, an electrical pulse train is obtained, the width of which can be said to be a measurement of the gas bubble size. The rotating part 16 can instead of being part of the impeller, constitute a separate part behind the impeller. It may also be possible, in the same manner as with the use of ribs 17 in this case, to utilize the ribs and as an alternative locate the electrodes at the front side of the pump wheel. The electrodes and the ribs must, however, be located with a part of the pump where gas has a tendency to collect.

Since in practical operation most often continuous pumping of a medium is practical, the present invention shows an advantageous registration and regulation of the gas bubble size can be done continuously, which is an advantage since all the time more or less gas is added to the pump together with the pump medium, and gas is continuously discharged in controlled quantities from the pump. In recent years it has become possible to pump pulp of consistencies between 8 and 15%, in certain cases even higher with centrifugal pumps, however the air or gas problems have increased in connection with this pumping, since generally the pulp contains more air the higher the concentration it has.

Depending upon how many ribs 17 the actual part of the pump has, one gets a number of pulses through the electrodes per unit of time, depending upon the speed of revolution of the pump. With an asynchronous motor drive of the pump the actual speed of revolution of the pump will decrease with increasing load. As a part of the invention it is possible to exactly determine the actual speed of revolution of the pump and through the so called lag as compared to the theoretical speed of revolution of the asynchrone motor determine the pump power consumption, which by means of suitable electric-electronic equipment can be registered continuously.

The effective method to register and control the gas bubble size in a centrifugal pump according to the present invention can thus be used to optimize the pump function by the fact that the pump pressure head and the volume capacity are depending upon the gas bubble size and of the pump speed of revolution. In common cases also pressure head and volume capacity are controlled by means of a throttle valve in the pipe line after the pump, which however can constitute a considerable power loss. The aim is therefore to throttle as little as possible in the valve and instead regulate the other variables, e.g. a computer can advantageously be used to obtain the lowest possible power consumption for a certain wanted pressure head and volume capacity, i.e. the greatest possible degree of efficiency.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of controlling the operation of a centrifugal pump in which gas has a tendency to collect in a bubble, when pumping a liquid or suspension which contains gas, comprising the steps of:

(a) sensing the size of the gas bubble by taking advantage of the difference in electrical conductivity between the gas in the bubble and the liquid or suspension being pumped; and (b) discharging gas from the pump so as to regulate the size of the bubble.

2. A method as recited in claim 1 wherein step (a) is practiced by providing a plurality of electrodes extending into operative association with the portion of said pump in which the bubble has a tendency to collect, the electrodes being spaced from each other; and by determining the current properties of an electrical current passing through one or more of the electrodes.

3. A method as recited in claim 2 wherein the pump has an impeller center, and wherein the gas has a tendency to collect in a bubble adjacent the impeller center; and wherein step (a) is further practiced by radially spacing the electrodes from the impeller center.

4. A method as recited in claim 3 wherein step (a) is further practiced by determining the voltage of current passing through one or more of said electrodes.

5. A method as recited in claim 4 wherein step (b) is practiced automatically in response to the voltage determinations obtained from step (a).

6. A method as recited in claim 3 wherein the impeller includes projections essentially radially extending thereon, the projections having the tendency to act on the gas bubble so that its radial periperhy is more or less in the shape of sawteeth; and wherein step (a) is further practiced by positioning the electrodes to take into account the sawteeth radial peripheral configuration of the bubble.

7. A method as recited in claim 1 wherein the material being pumped comprises a cellulosic fibrous material suspension.

8. A method as recited in claim 7 wherein the suspension being pumped has a solids consistency of about 8–15 percent.

9. A centrifugal pump having an impeller, and comprising:

(a) a pump wall, defining with said impeller a chamber in which gas has a tendency to collect when the pump pumps liquid or suspension which contains gas;

(b) means for sensing the size of the gas bubble collecting in said chamber by taking advantage of the differences in electrical conductivity between the gas in the bubble and the liquid or suspension being pumped; and (c) means for discharging gas from said chamber in order to regulate the size of said bubble.

10. A pump as recited in claim 9 wherein said means (b) comprise a plurality of electrodes extending through said wall into operative association with said chamber.

11. A pump as recited in claim 10 wherein each of said electrodes is electrically connected through a resistor to a source of electrical current.

12. A pump as recited in claim 11 further comprising a volt meter operatively connected across one of said resistors.

13. A pump as recited in claim 12 wherein said impeller includes an impeller center through which the axis of rotation of said impeller extends, said axis of rotation passing through said wall; and wherein said electrodes are radially spaced from each other and from the point of intersection of said axis of rotation with said wall.

14. A pump as recited in claim 13 further comprising an asynchronous motor operatively connected to said impeller for rotating said impeller.

15. A pump as recited in claim 13 wherein said impeller includes a plurality of generally radially extending projections operatively connected thereto and rotating with said impeller in said chamber.

* * * * *